US006779211B1

(12) United States Patent
Williams

(10) Patent No.: US 6,779,211 B1
(45) Date of Patent: Aug. 24, 2004

(54) BABY SUPPORT ASSEMBLY AND A METHOD FOR FORMING A BABY SUPPORT ASSEMBLY

(76) Inventor: Ann Williams, 1006 Butternut, Royal Oak, MI (US) 48073

( * ) Notice: Subject to any disclaimer, the term of this patent is extended or adjusted under 35 U.S.C. 154(b) by 53 days.

(21) Appl. No.: 10/139,721

(22) Filed: May 4, 2002

(51) Int. Cl.[7] ..... A47C 20/02
(52) U.S. Cl. ..... 5/655; 5/640; 5/657; D6/601
(58) Field of Search ..... 5/655, 640, 657, 5/722, 723, 922, 653; D6/601

(56) References Cited

U.S. PATENT DOCUMENTS

| | | | | | |
|---|---|---|---|---|---|
| D318,202 | S | | 7/1991 | Weber | |
| 5,154,649 | A | * | 10/1992 | Pender | 5/655 |
| 5,193,238 | A | | 3/1993 | Clute | |
| 5,257,429 | A | * | 11/1993 | Genis | 5/636 |
| 5,261,134 | A | | 11/1993 | Matthews | |
| 5,272,780 | A | | 12/1993 | Clute | |
| 5,450,640 | A | * | 9/1995 | Patton et al. | 5/655 |
| D369,054 | S | | 4/1996 | Straub et al. | |
| D369,934 | S | | 5/1996 | Straub et al. | |
| 5,528,784 | A | * | 6/1996 | Painter | 5/640 |
| 5,642,543 | A | * | 7/1997 | Huntley | 5/640 |
| 5,790,999 | A | * | 8/1998 | Clark | 5/655 |
| D408,676 | S | | 4/1999 | Straub et al. | |
| 5,930,854 | A | * | 8/1999 | O'Neill et al. | 5/655 |
| 6,061,854 | A | * | 5/2000 | Crowley | 5/655 |
| 6,079,067 | A | * | 6/2000 | Becker et al. | 5/655 |
| D432,846 | S | | 10/2000 | Parker et al. | |
| 6,182,314 | B1 | * | 2/2001 | Frydman | 5/648 |
| D450,516 | S | | 11/2001 | Darling et al. | |
| D450,517 | S | | 11/2001 | Darling et al. | |
| 6,564,408 | B2 | * | 5/2003 | Van Vuuren | 5/655 |

* cited by examiner

*Primary Examiner*—Teri Pham Luu
(74) *Attorney, Agent, or Firm*—Dierker & Associates P.C.

(57) ABSTRACT

A baby support assembly 10 which includes selectively stackable members 12, 30 which cooperatively and selectively support the positioning of a baby 91 upon the lap 92 of a mother or other individual 90.

18 Claims, 3 Drawing Sheets

BABY SUPPORT ASSEMBLY AND A METHOD FOR FORMING A BABY SUPPORT ASSEMBLY

FIELD OF THE INVENTION

The present invention generally relates to a baby support assembly and a method for forming a baby support assembly and more particularly, to a baby support assembly which may be selectively and removably assembled, effective to allow a baby lo be securely positioned on the lap of an individual or on another location.

BACKGROUND OF THE INVENTION

Frequently, it is necessary and/or desirable to place a baby upon the lap of an individual, such as a mother, in order to allow the mother to nurse or to otherwise attend to the baby, allow a mother's hands to be free; and minimize back and arm strain. At the outset, it should be realized that while the following discussion describes the placement of a baby upon a lap, it is equally applicable to the placement of the baby upon any surface or other location. Moreover, it is also very desirable to ensure that the baby remains substantially stationary as the baby is being bottle fed or nursed or attended to in order to reduce the likelihood that the baby will fall from the top of the mother and be injured and in order to allow the mother to easily feed or otherwise attend to the baby.

One approach to supporting the baby on the lap of the mother requires the use of a flat pillow which is placed upon the lap and upon which the baby is placed. While this approach does allow the baby to be selectively placed upon the lap and provides some comfort for the baby and mother, it does not adequately ensure that the baby will remain in a desired position and, in fact, may actually cause the baby to fall off the lap due to its shape and size (e.g., the shape and size of the pillow may actually increase the instability of the placement of baby upon the mother's lap).

A second approach which provides greater stability in the placement of the baby upon the mother's lap requires the use of a single short and relatively arcuate type pillow which is placed upon the mother's lap and which "wraps" around the back and the sides of the baby. While this approach does desirably provide some support for the back and the sides of the baby, it does not appreciably reduce the likelihood of an undesired fall and is of very little use for larger or longer babies. Hence, such a short pillow becomes obsolete in very short order. Furthermore, while this approach does provide some support for the back, arms, and the sides of the mother, it does not appreciably reduce the strain upon the major muscles (non-limitative examples of which include back, neck, arms, chest, and sides) which are associated with holding and/or supporting a baby. That is, due to the relatively short architecture of the single arcuate pillow (i.e., the height of the single pillow only raises the baby's head and body a few inches closer to the mother'S upper body), a mother or another individual continues to require the use of the major muscles of her/his body to support the baby.

There is therefore a need for a new and improved baby support assembly which overcomes some or all of the previously delineated drawbacks of existing baby support assemblies.

SUMMARY OF THE INVENTION

It is a first non-limiting advantage of the present invention to provide a baby support assembly and a method for forming a baby support assembly which overcomes some or all of the previously delineated disadvantages of prior baby support assemblies.

It is a second non-limiting advantage of the present invention to provide a baby support assembly which may be used with babies of various sizes.

It is a third non-limiting advantage of the present invention to provide a baby support assembly of a selected height.

It is a fourth non-limiting advantage of the present invention to provide a baby support assembly which may provide significantly more back, neck, and arm support for a mother than a single short pillow when feeding a baby in an upright or lying down position.

It is a fifth non-limiting advantage of the present invention to provide a baby support assembly which incorporates a fastening device and which allows for substantial flexibility in positioning a top pillow upon a bottom pillow as well as positioning a baby within the baby support assembly.

It is a sixth non-limiting advantage of the present invention to provide a baby support assembly. Particularly, the baby support assembly includes a first arcuate portion having at least one first attachment member; and a second arcuate portion having at least a second attachment member which cooperates with the first attachment member to allow the second arcuate portion to be selectively and removably attached to the first arcuate portion.

It is a seventh non-limiting advantage of the present invention to provide a baby support assembly. Particularly, the baby support assembly includes a first "C" shaped pillow member having a first cylindrical cross sectional area of a certain first width and further having a first back support portion and two substantially identical first arm portions, each of the substantially identical first arm portions being of a substantially identical first length and forming a first acute angle with the first back support portion. Further, the baby support assembly includes a second "C" shaped pillow member having a second cylindrical cross sectional area which is about one half of the certain first width of the first cylindrical cross sectional area and further having a second back support portion and two substantially identical second arm portions, each of the two substantially identical second arm portions having a second length which is shorter than the first length and forming a second acute angle with the second back support portion, the second acute angle being greater than the first acute angle. A first attachment member may be attached to the first "C" shaped pillow member, and a second attachment member may be attached to the second "C" shaped pillow member and may cooperate with the first attachment member to allow the second "C" shaped pillow member to be attached to the first "C" shaped pillow member.

It is a an eighth non-limiting advantage of the present invention to provide a method for forming a baby support assembly. Particularly, the method includes the steps of providing a first "C" shaped member; providing a second "C" shaped member; and stackably coupling the second "C" shaped member to the first "C" shaped member, thereby forming the baby support assembly.

These and other features and advantages of the present invention will become apparent from the following detailed description of embodiments of the invention and by reference to the following drawings.

DETAILED DESCRIPTION OF EMBODIMENTS OF THE INVENTION

Figure 1:
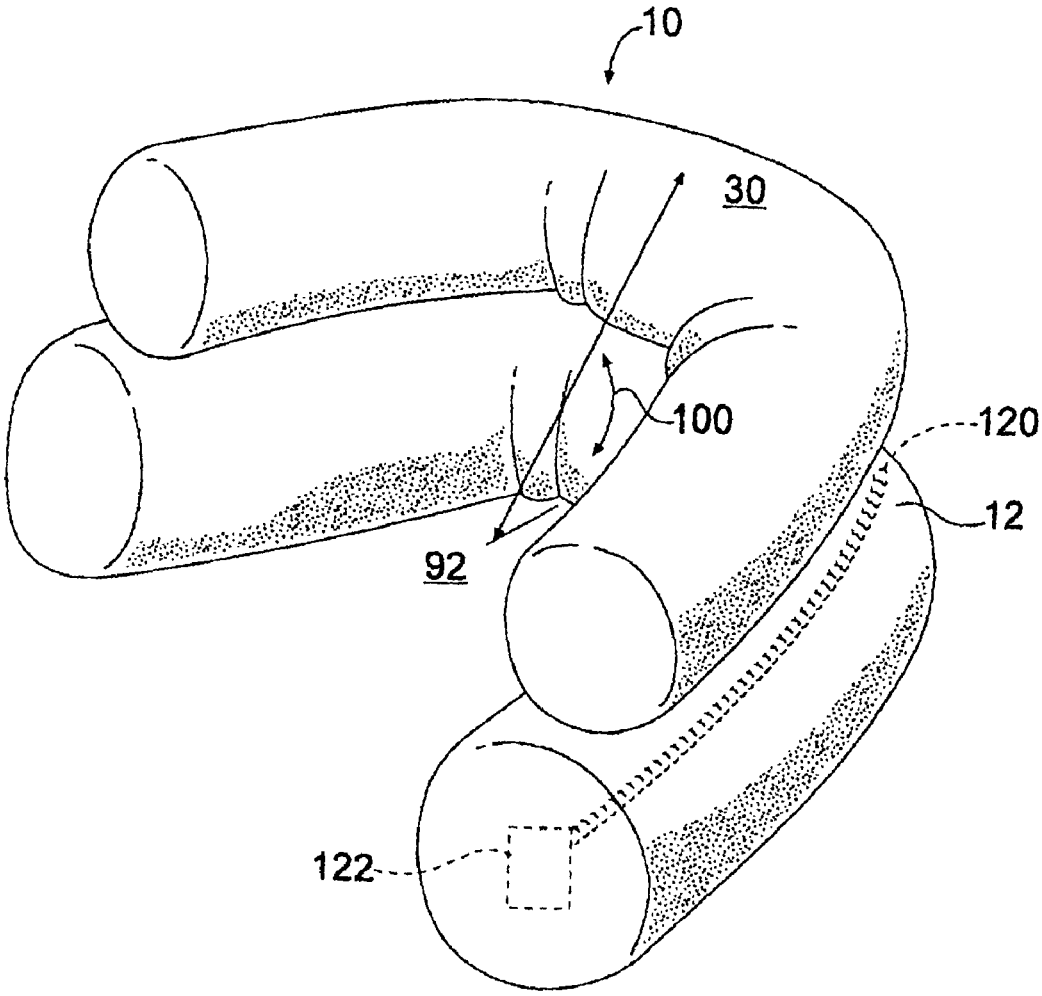
FIG. 1 is a perspective and assembled view of a baby support assembly which is made in accordance with the teachings of the preferred embodiment of the invention.
Figure 2:
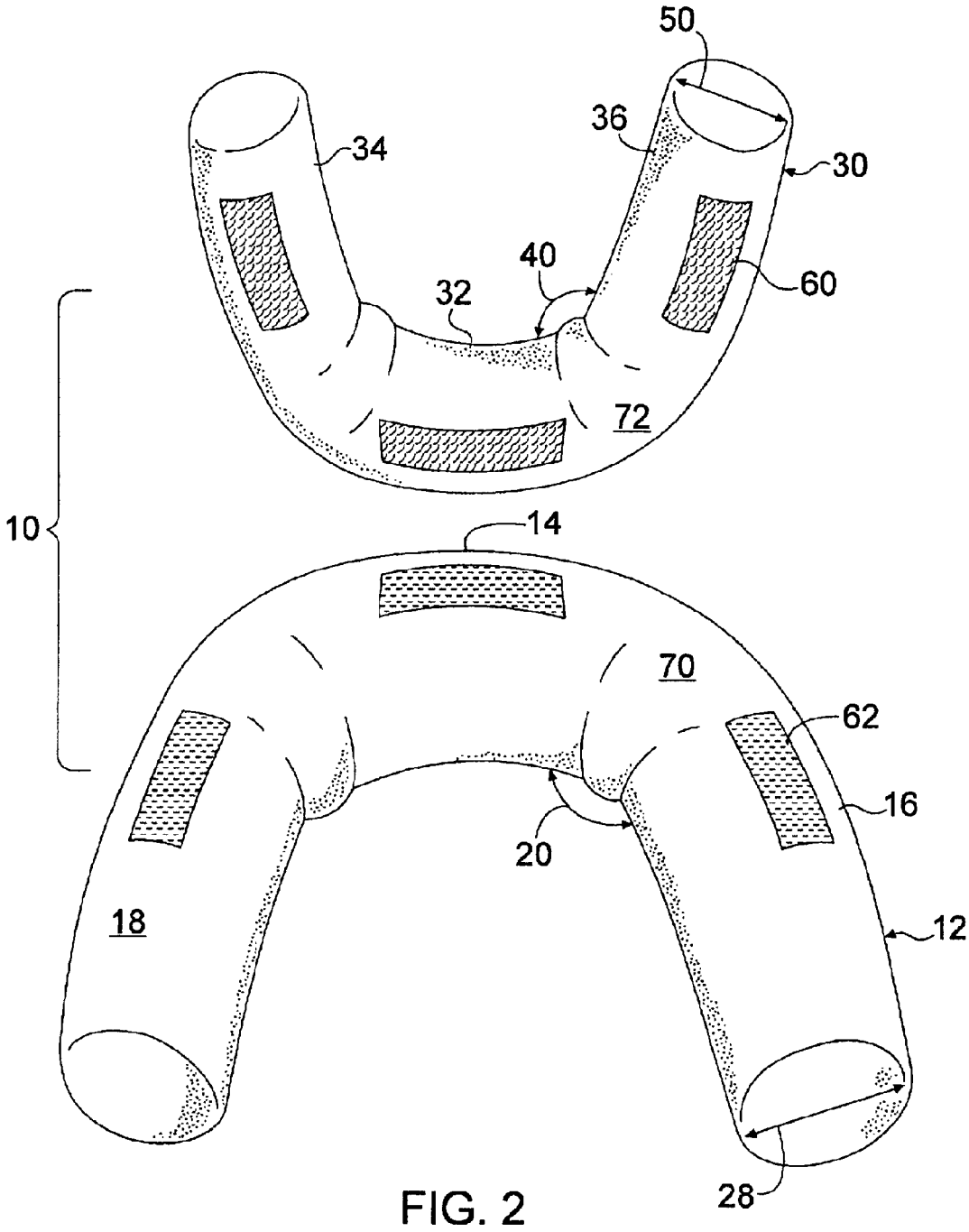
FIG. 2 is a perspective unassembled view of the baby support assembly which is shown in FIG. 1.

Referring now to FIGS. 1 and 2, a baby support assembly according to an embodiment of the present invention is generally designated as 10. Particularly, the baby support assembly 10 includes a first generally "C" shaped or arcuate pillow member 12 having an arcuate back support portion 14 and a pair of substantially identical arm portions 16, 18 which are integral with and which integrally terminate within the back support portion 14. Particularly, each of the substantially identical arm portions 16, 18 forms a substantially identical angle 20 with the back portions 14. In the preferred embodiment of the invention, angle 20 ranges between about ninety-six and about one hundred and ten degrees, although other non-acute angles may be used. As is shown, the member 12 has a general cross sectional area which is cylindrical or tubular in shape and which has a certain width 28. In the preferred embodiment of the invention, the width 28 varies between about six and about eight inches, although other dimensions maybe utilized.

The baby support assembly 10 further includes a second "C" shaped or arcuate pillow member 30 having a back support portion 32 and two substantially identical end or arm portions 34, 36. Particularly, each of the substantially identical arm portions 34, 36 are integrally formed with the back support portion 32 and integrally terminate and emanate from the back support portion 32. In the preferred embodiment of the invention, each of the substantially identical arm portions 34, 36 form a substantially identical angle 40 with the back support portion 32 and this angle 40 is substantially greater (by about ten to about fifteen degrees) than the angle 20, although other angles 40 may be used. In the preferred embodiment of the invention, the second arcuate and "C" shaped member 30 has a tubular and/or generally cylindrical cross sectional area having a width 50 ranging between about ten and about fifty percent smaller then the width 28. It is to be further understood that any suitable length may be used for the aims or end members 34, 36. In the preferred embodiment of the invention, the length of each of the arms or end members 34, 36 ranges between about ten and about twenty percent less than the length of each of the arms or end members 16, 18.

In one non-limiting embodiment of the invention, the second "C" shaped or arcuate pillow member 30 may further include a selectively removable distraction assembly or toy portion attached or coupled to the outer surface of pillow member 30. The toy portion may be effective to entertain or distract a infant or baby while he or she is contained or supported within the baby support assembly 10. The distraction assembly or toy portion may be selectively and removably attached to the pillow member 30 by use of such attachment assemblies as a belt and buckle, a strap and clasp, a button and button hole, a hook-and-loop fastener (one non-limitative example of which is commercially available under the trademark VELCRO®, from Velcro Industries B.V. located in Manchester, N.H.) or substantially any desired and/or commercially available fastening assembly.

Figure 3:
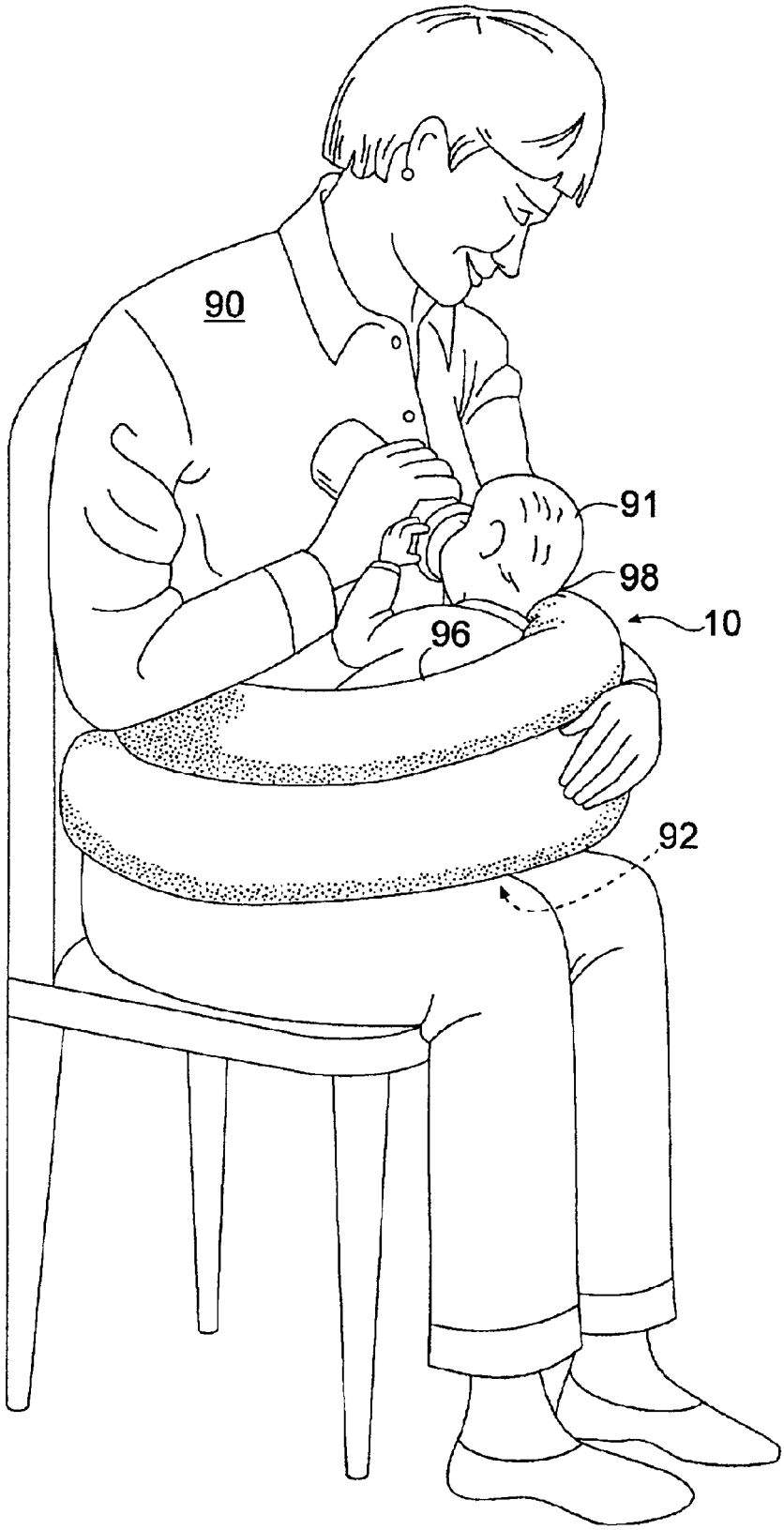
FIG. 3 is a perspective view of a mother employing the baby support assembly of the preferred embodiment of the invention to attend to a baby.

As is further shown, member 30 includes at least one (in the preferred embodiment of the invention about three) attachment member 60 and the member 12 includes at least one (in the preferred embodiment of the invention about three) attachment member 62. In particular, each attachment member 60 is "complementary" to an attachment member 62. The term "complementary" means, in this description, that physical contact between a pair of attachment members 60, 62 causes the physically contacting attachment members 60, 62 to be secured. For example and without limitation, attachment members 60, 62 are conventional and complementary hook-and-loop fastener type members. Other fastening assemblies and techniques may alternatively be utilized to selectively and removably secure the member 30 to the member 12 in a selectively "stackable" manner as is described below and is shown in FIGS. 1 and 3. Further, in the most preferred embodiment of the invention, the at least one attachment member 62 is placed upon a first surface 70 of the member 12 while the at least one attachment member 60 is placed upon the bottom surface 72 of the member 30. That is, as shown best in the FIGS. 1–3, the "bottom" surface 72 is the surface which, when attached to the surface 70, allows the member 30 to be stacked on top of the member 12 and to allow the end members 34, 36 to respectively reside about the members 18, 16. As should be apparent to those of ordinary skill in the art, each of the attachment members 60 is selectively and physically coupled to one of the attachment members 62.

As best shown in FIG. 3, a mother 90 (or another individual) may use the baby support assembly 10 to support a baby 91 upon her lap 92 in order to attend to the needs of the baby 91. Particularly, in one non-limiting embodiment, the first member 12 is placed on the lap 92. The member 30 is then selectively and "stackably" coupled to the member 12 by attaching each of the attachment members 60 to a unique one of the attachment members 62. The baby 91 is then placed within the formed assembly 10 in a desired position, such as the position shown in FIG. 3. It should be understood that nothing in this description is meant to limit the position of the baby 91 while within the formed assembly. Rather, the position of the baby 91 shown in FIG. 3 is for illustrative purposes only and is one of a plurality of positions in which the baby 91 may be supportably received by the formed assembly 10. For example and without limitation, the baby or infant may be supportably received by the formed assembly 10 while in an upright or sitting position, a substantially horizontal or laying position, or substantially any desired position in which the mother (or individual who is attending to the baby or infant) and the baby or infant itself is/are comfortable.

Particularly, the back 96 and the head 98 of the baby 91 are supported by the back operatively assembly back portions 14, 32. It is to be understood that the operatively assembled baby support assembly 10 may dramatically reduce the likelihood that the baby 91 will undesirably fall off the lap 92. Importantly, the selectively stacked members 12, 30 form an angle of inclination 100 with the lap 92, thereby allowing for a relatively comfortable and secure positioning of the baby 91 within the formed assembly 10. It is to be understood that any suitable angle of inclination may be selected. In one non-limiting embodiment, the angle of inclination 100 is about thirty degrees. Further, in yet another non-limiting embodiment, a heating element 120 may be disposed in each pillow member 12, 30 and "runs" along the entire length of the member 12, 30 in which they are respectively disposed. Each heating element 120 is coupled to a unique solar panel 122 which provides electrical energy generally sufficient to heat the members 12, 30 and provide heat to the baby 91.

It is to be understood that an additional "C" shaped pillow member may be selectively coupled to member 30, thereby selectively increasing the height of the assembly 10 in order to accommodate taller/larger babies.

In one non-limiting embodiment of the invention, the first generally "C" shaped or arcuate pillow member 12 may be removed and the second generally "C" shaped or arcuate pillow member 30 is utilized alone. Particularly, the second pillow member 30 may include at lest one attachment member, such as attachment member 60. In this alternate embodiment of the invention, the second (smaller) generally "C" shaped or arcuate pillow member 30 may be selectively and removably attached to a desired surface, such as a chair or another substantially similar or substantially different shaped pillow. In this embodiment the second pillow member 30 (without the first pillow member 12) has a substantially improved and substantially greater diversified range of functionality.

It should be further appreciated that the baby support assembly 10 provides a plurality of benefits for the baby. For example and without limitation, the baby support assembly 10 provides a means for feeding a baby in an upright manner, which many pediatricians agree helps or aids in baby digestion and substantially reduces "spit-up" or regurgitation. In a further example the baby support assembly 10 supports a baby that cannot yet sit on his/her own, thereby helping or assisting the baby in building neck muscles and further substantially reducing the potentiality of the baby acquiring "flat head" (i.e., a condition which babies may acquire that affects "soft spots" or fontanelles remaining in the incompletely ossified or hardened skull of a baby. This condition may be contributed to by a baby applying pressure upon the back portion of his/her skull which oftentimes occurs while laying on his/her back).

Furthermore, it is to be understood that, the baby support assembly 10 provides a plurality of benefits for the mother (or another individual) as well. For example and without limitation, the baby support assembly 10 provides a means for feeding a baby which allows the mother (or another individual) to utilize both of her (or his) arms and hands rather than just one arm and hand while the other arm and hand holds the baby. In this manner, the mother (or another individual) may be spared some of the strain upon the arms and back which oftentimes is associated with attempting to hold a baby while concomitantly feeding the baby. In a further non-limitative example the baby support assembly 10 allows a mother (or another individual) to perform other tasks while the baby is supportably contained within the support assembly 10. Some non-limitative examples include but are not limited to the mother working at a computer, sitting and eating at a dinner table, talking on the telephone, or performing substantially any desired task which the mother (or another individual) may desire to perform while using the baby support assembly 10 to support a baby.

While several embodiments of the present invention have been described in detail, it will be apparent to those skilled in the art that the disclosed embodiments maybe modified. Therefore, the foregoing description is to be considered exemplary rather than limiting, and the true scope of the invention is that defined in the following claims.

What is claimed is:

1. A baby support assembly comprising:

a first arcuate portion having at least one first attachment member; and a second arcuate portion adapted to be smaller than the first arcuate portion, and having at least a second attachment member which cooperates with said first attachment member to allow said second arcuate portion to be selectively and removably attached to said first arcuate portion;

wherein said first and said second arcuate portion comprise an inclined back support surface.

2. The baby support assembly of claim 1 wherein said first attachment member comprises a hooks-and-loop fastener member.

3. The baby support assembly of claim 1 wherein said back support surface has an angle of inclination of about thirty degrees.

4. The baby support assembly of claim 3 wherein said first and said second arcuate portion each have at least one of a generally tubular and a generally cylindrical cross sectional area.

5. A baby support assembly comprising:

a first arcuate portion having at least one first attachment member;

a second arcuate portion, having at least a second attachment member which cooperates with said first attachment member to allow said second arcuate portion to be selectively and removably attached to said first arcuate portion;

a heating element which is disposed in said first arcuate portion; and a solar panel which is coupled to said heating element;

wherein said first and said second arcuate portion comprise an inclined back support surface, wherein said back support surface has an angle of inclination of about thirty degrees, and wherein said first and said second arcuate portion each have a generally cylindrical cross sectional area.

6. The baby support assembly of claim 5 further comprising at least one selectively removable distraction assembly which is selectively attachable to said second arcuate portion.

7. The baby support assembly of claim 6 wherein said at least one selectively removable distraction assembly is selectively and removably attachable by use of at least one strap and clasp assembly which circumscribes said second arcuate portion and selectively and removably attaches said at least one distraction assembly to said second arcuate portion.

8. The baby support assembly of claim 6 wherein said selectively removable distraction assembly is selectively movable by use of a hook-and-loop fastener.

9. A baby support assembly comprising:

a first "C" shaped pillow member having a first generally cylindrical cross sectional area of a certain first width and further having a first back support portion and two substantially identical first arm portions, each of said substantially identical first arm portions being of a substantially identical length and forming a first acute angle with said first back support portion;

a second "C" shaped pillow member having a second generally cylindrical cross sectional area which is about one half of said certain first width of said first generally cylindrical cross sectional area and further having a second back support portion and two substantially identical second arm portions, each of said two substantially identical second arm portions having a second length which is shorter than said first length and forming a second acute angle with said second back support portion, said second acute angle being greater than said fist acute angle;

a first attachment member which is attached to said first "C" shaped pillow member; and a second attachment member which is attached to said second "C" shaped pillow member and which cooperates with said first attachment member to allow said second "C" shaped pillow member to be attached to said first "C" shaped pillow member, said first and second pillow members forming an acute angle of inclination.

10. The baby support assembly of claim 9 further comprising:

a first heating element which is disposed in said fist "C" shaped pillow member;

a first sonar panel which is mounted upon said first "C" shaped pillow member and which is mounted upon said first "C" shaped pillow member and which is coupled to said first heating element;

a second heating element which is disposed in said second "C" shaped pillow member; and a second solar panel which is mounted upon said second "C" shaped pillow member and which is coupled to said second heating element.

11. The baby support assembly of claim 9 further comprising at least one selectively removable distraction assembly which is selectively and removably attachable to said second arcuate portion.

12. The baby support assembly of claim 11 wherein said at least one selectively removable distraction means is selectively and removably attachable by use of a strap and clasp assembly which circumscribes said second arcuate portion and selectively and removably attaches said at least one distraction assembly to said second arcuate portion.

13. The baby support assembly of claim 11 wherein said at least one selectively removable distraction assembly is selectively removable by use of a hook-and-loop fastener.

14. A method for forming a baby support assembly, said method comprising the steps of:

providing a first "C" shaped member;

providing a second "C" shaped member;

stackably and removably coupling said second "C" shaped member to said "C" shaped member, thereby forming said baby support assembly;

disposing a heating element in said first "C" shaped member; and coupling a solar panel to said heating element.

15. A method for forming a baby support assembly, said method comprising the steps of:

provide a first "C" shaped member having a first width and opposed arm portions each having a first length;

providing a second "C" shaped member having a second width and opposed arm portions each having a second length, wherein each of said second width and second length is smaller than said first width and first length, respectively; and stackably and removably coupling said second "C" shaped member to said first "C" shaped member, thereby forming said baby support assembly.

16. A method for forming a baby support assembly, said method comprising the steps of:

providing a first "C" shaped member;

providing a second "C" shaped member adapted to be smaller than said first "C" shaped member;

stackably and removably coupling said second "C" shaped member to said first "C" shaped member, thereby forming said baby support assembly; and selectively attaching a selectively removable distraction assembly to said second "C" shaped member.

17. The method of claim 15 wherein said step of stackably and removably coupling said second "C" shaped member to said first "C" shaped member further comprises the steps of:

coupling at least one first attaching device to a top side of said first "C" shaped member in a first position; and coupling at least one second attaching device, which is complementary to said at least one first attaching device, to a bottom side of said second "C" member in a second position which is complementary with said at least one first attaching device in said first position.

18. A method for forming a baby support assembly, said method comprising the steps of:

providing a first "C" shaped member;

providing a second "C" shaped member adapted to be smaller than said first "C" shaped member;

stackably and removably coupling said second "C" shaped member to said first "C" shaped member, thereby forming said baby support assembly; wherein said step of stackably and removably coupling said second "C" shaped member to said first "C" shaped member further comprises the steps of:

coupling at least one first attaching device to a top side of said first "C" shaped member in a first position;

coupling at least one second attaching device, which is complementary to said at least one first attaching device, to a bottom side of said second "C" shaped member in a second position which is complementary with said at least one first attaching device in said first position; and aligning said at least one first and said at least one second attaching device to create a certain acute angle of inclination.

* * * * *